US011781461B2

(12) United States Patent
Yasoshina et al.

(10) Patent No.: US 11,781,461 B2
(45) Date of Patent: Oct. 10, 2023

(54) EXHAUST DEVICE OF ENGINE AND WORK MACHINE

(71) Applicant: HONDA MOTOR CO., LTD., Tokyo (JP)

(72) Inventors: Sayaka Yasoshina, Saitama (JP); Atsushi Murao, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/683,922

(22) Filed: Mar. 1, 2022

(65) Prior Publication Data

US 2022/0290600 A1 Sep. 15, 2022

(30) Foreign Application Priority Data

Mar. 11, 2021 (JP) ..... 2021-038968

(51) Int. Cl.
*F01N 3/28* (2006.01)
*G10K 11/16* (2006.01)
*F01N 1/02* (2006.01)

(52) U.S. Cl.
CPC ..... *F01N 3/2885* (2013.01); *F01N 1/02* (2013.01); *G10K 11/161* (2013.01)

(58) Field of Classification Search
CPC ..... F01N 3/2885; F01N 1/02
See application file for complete search history.

(56) References Cited

U.S. PATENT DOCUMENTS 4,094,644 A * 6/1978 Wagner ..... F01N 1/08 422/181
2006/0283180 A1* 12/2006 Hiraga ..... F01N 3/2885 60/299
2012/0124968 A1* 5/2012 Tamamidis ..... F01N 13/017 60/274
2018/0051617 A1* 2/2018 Sasaki ..... F01N 1/00

FOREIGN PATENT DOCUMENTS

JP 2007092663 A 4/2007
JP 2011085113 A 4/2011

OTHER PUBLICATIONS

Notice of Reasons for Refusal for Japanese Patent Application 2021-038968 dated Jan. 10, 2023; 4 pp.

* cited by examiner

*Primary Examiner* — Anthony Ayala Delgado
(74) *Attorney, Agent, or Firm* — Armstrong Teasdale LLP

(57) ABSTRACT

An exhaust device of an engine includes: a muffler provided with a plurality of muffling chambers separated by a plurality of partition walls, a communication pipe accommodated in the muffler and penetrating at least one of the partition walls, and a catalyst accommodated in the muffler and penetrating at least one of the partition walls, wherein the muffling chambers include: a pair of first muffling chambers each provided with an inlet port for exhaust gas; a second muffling chamber communicating with the pair of first muffling chambers via the communication pipe; and a third muffling chamber communicating with the second muffling chamber via the catalyst.

12 Claims, 6 Drawing Sheets

EXHAUST DEVICE OF ENGINE AND WORK MACHINE

TECHNICAL FIELD

The present invention relates to an exhaust device of an engine and a work machine.

BACKGROUND ART

Conventionally, an engine is provided with an exhaust device for discharging exhaust gas generated in a combustion process. The exhaust device includes an exhaust pipe through which the exhaust gas passes, a catalyst configured to purify the exhaust gas, a muffler configured to reduce an exhaust sound, and the like.

For example, JP2007-92663A discloses an exhaust muffler accommodating a catalytic converter. This exhaust muffler includes a first expansion chamber, a second expansion chamber communicating with the first expansion chamber via a first communication pipe, a third expansion chamber communicating with the second expansion chamber via the catalytic converter, and a fourth expansion chamber communicating with the third expansion chamber via a second communication pipe.

In the exhaust muffler disclosed in JP2007-92663A, the exhaust gas from a right exhaust gas inlet pipe flows into the second expansion chamber via the first expansion chamber and the first communication pipe. By contrast, the exhaust gas from a left exhaust gas inlet pipe flows directly into the second expansion chamber without passing through the first expansion chamber and the first communication pipe. Thus, the length of the flowing path of the exhaust gas from the right exhaust gas inlet pipe is totally different from that of the exhaust gas from the left exhaust gas inlet pipe. Accordingly, the exhaust sound of the exhaust gas from the left and right exhaust gas inlet pipes may not be reduced in a well-balanced manner.

SUMMARY OF THE INVENTION

In view of the above background, an object of the present invention is to provide an exhaust device that is provided with a muffler accommodating a catalyst and can reduce an exhaust sound of exhaust gas introduced from a pair of inlet ports in a well-balanced manner.

To achieve such an object, one aspect of the present invention provides an exhaust device (5) of an engine (1), comprising: a muffler (33) provided with a plurality of muffling chambers (51 to 53) separated by a plurality of partition walls (34 to 36), a communication pipe (37) accommodated in the muffler and penetrating at least one of the partition walls, and a catalyst (38) accommodated in the muffler and penetrating at least one of the partition walls, wherein the muffling chambers include: a pair of first muffling chambers (51) each provided with an inlet port (54) for exhaust gas; a second muffling chamber (52) communicating with the pair of first muffling chambers via the communication pipe; and a third muffling chamber (53) communicating with the second muffling chamber via the catalyst.

According to this aspect, the exhaust gas introduced from either of the inlet ports of the pair of first muffling chambers passes through the pair of first muffling chambers, the communication pipe, the second muffling chamber, the catalyst, and the third muffling chamber in this order. That is, the exhaust gas introduced from the inlet ports of the pair of first muffling chambers passes through similar flowing paths. Accordingly, it is possible to reduce the exhaust sound of the exhaust gas introduced from the inlet ports of the pair of first muffling chambers in a well-balanced manner.

In the above aspect, preferably, the pair of first muffling chambers are formed at both ends of the muffler in a longitudinal direction thereof, the second muffling chamber and the third muffling chamber are formed between the pair of first muffling chambers, and the partition walls include: a first partition wall (34) separating one of the pair of first muffling chambers and the second muffling chamber; a second partition wall (35) separating the second muffling chamber and the third muffling chamber; and a third partition wall (36) separating the third muffling chamber and another of the pair of first muffling chambers.

According to this aspect, the pair of first muffling chambers, the second muffling chamber, and the third muffling chamber can be formed inside the muffler with a simple configuration.

In the above aspect, preferably, the third muffling chamber communicates with an external space (S) on one side of the muffler in the longitudinal direction thereof via an outlet pipe (40) extending in the longitudinal direction of the muffler.

According to this aspect, the third muffling chamber can communicate with the external space on the one side of the muffler in the longitudinal direction thereof with a simple configuration.

In the above aspect, preferably, the muffler includes: a tubular portion (45) extending in the longitudinal direction of the muffler; and a pair of lid portions (46) covering openings (45A) at both ends of the tubular portion, and the outlet pipe penetrates one of the pair of lid portions, the first partition wall, and the second partition wall, and protrudes to the one side of the muffler in the longitudinal direction thereof.

According to this aspect, the outlet pipe can be prevented from protruding from an outer circumferential surface of the tubular portion, so that the exhaust device can be made compact.

In the above aspect, preferably, the communication pipe extends in the longitudinal direction of the muffler, and penetrates the first partition wall, the second partition wall, and the third partition wall.

According to this aspect, the pair of first muffling chambers separated by the second and third muffling chambers can communicate with each other with a simple configuration.

In the above aspect, preferably, communication ports (56) communicating with the pair of first muffling chambers are provided at both ends of the communication pipe, and multiple communication holes (57) communicating with the second muffling chamber are provided on an outer circumferential portion of the communication pipe.

According to this aspect, the exhaust gas that has flowed into the communication pipe via the communication ports diffuses into the second muffling chamber via the multiple communication holes. Accordingly, the muffling performance of the muffler can be improved.

In the above aspect, preferably, the catalyst is accommodated in a catalyst case (39), and the catalyst and the catalyst case penetrate the second partition wall.

According to this aspect, the second muffling chamber and the third muffling chamber can communicate with each other via the catalyst with a simple configuration.

In the above aspect, preferably, the catalyst case includes: a first tubular body (61) extending in the longitudinal direction of the muffler and covering an outer circumference of the catalyst; a second tubular body (62) fixed to an outer circumference of a first end of the first tubular body; and a third tubular body (63) fixed to an inner circumference of a second end of the first tubular body, the second tubular body is supported by the second partition wall, and the third tubular body is supported by the third partition wall.

According to this aspect, the second and third partition walls can support the catalyst case in a well-balanced manner.

In the above aspect, preferably, a first end of the third tubular body is fixed to the inner circumference of the second end of the first tubular body, a second end of the third tubular body is covered with a lid body (64), and multiple outer circumferential holes (67) communicating with the third muffling chamber are provided on an outer circumferential portion of the third tubular body.

According to this aspect, the exhaust gas flowing from the first tubular body to the third tubular body diffuses into the third muffling chamber via the multiple outer circumferential holes. Accordingly, the muffling performance of the muffler can be improved.

In the above aspect, preferably, the first tubular body is welded to the catalyst, the second tubular body is welded to the first tubular body and the second partition wall, and the third tubular body is welded to the first tubular body and fitted into the third partition wall so as to slide relative to the third partition wall.

According to this aspect, even if the catalyst thermally expands and extends in the longitudinal direction of the muffler, the third tubular body slides relative to the third partition wall, so that the extension of the catalyst can be absorbed. Accordingly, the damage to the catalyst and the catalyst case can be suppressed.

In the above aspect, preferably, volumes of the muffling chambers become smaller in order of a total volume of the pair of first muffling chambers, a volume of the second muffling chamber, and a volume of the third muffling chamber.

According to this aspect, the volumes of the muffling chambers can be gradually decreased from an upstream side to a downstream side in an exhaust direction. Accordingly, the muffling performance of the muffler can be improved.

In the above aspect, preferably, the engine includes an engine body (3) rotatably supporting a crankshaft (11), an output portion (12) of the crankshaft protrudes on one side surface of the engine body, and the muffler is arranged along the one side surface of the engine body.

According to this aspect, the muffler can be arranged along the one side surface (that is, a surface on which the output portion of the crankshaft protrudes) of the engine body. Accordingly, the muffler is less likely to limit the layout of other parts.

To achieve such an object, another aspect of the present invention provides a work machine (P) comprising the engine including the exhaust device.

According to this aspect, it is possible to reduce the exhaust sound of the exhaust gas from the work machine in a well-balanced manner.

Thus, according to the above aspects, it is possible to provide an exhaust device that is provided with a muffler accommodating a catalyst and can reduce an exhaust sound of exhaust gas introduced from a pair of inlet ports in a well-balanced manner.

BRIEF DESCRIPTION OF THE DRAWING(S)

DETAILED DESCRIPTION OF THE INVENTION

<V-Type Engine 1>

Figure 1:
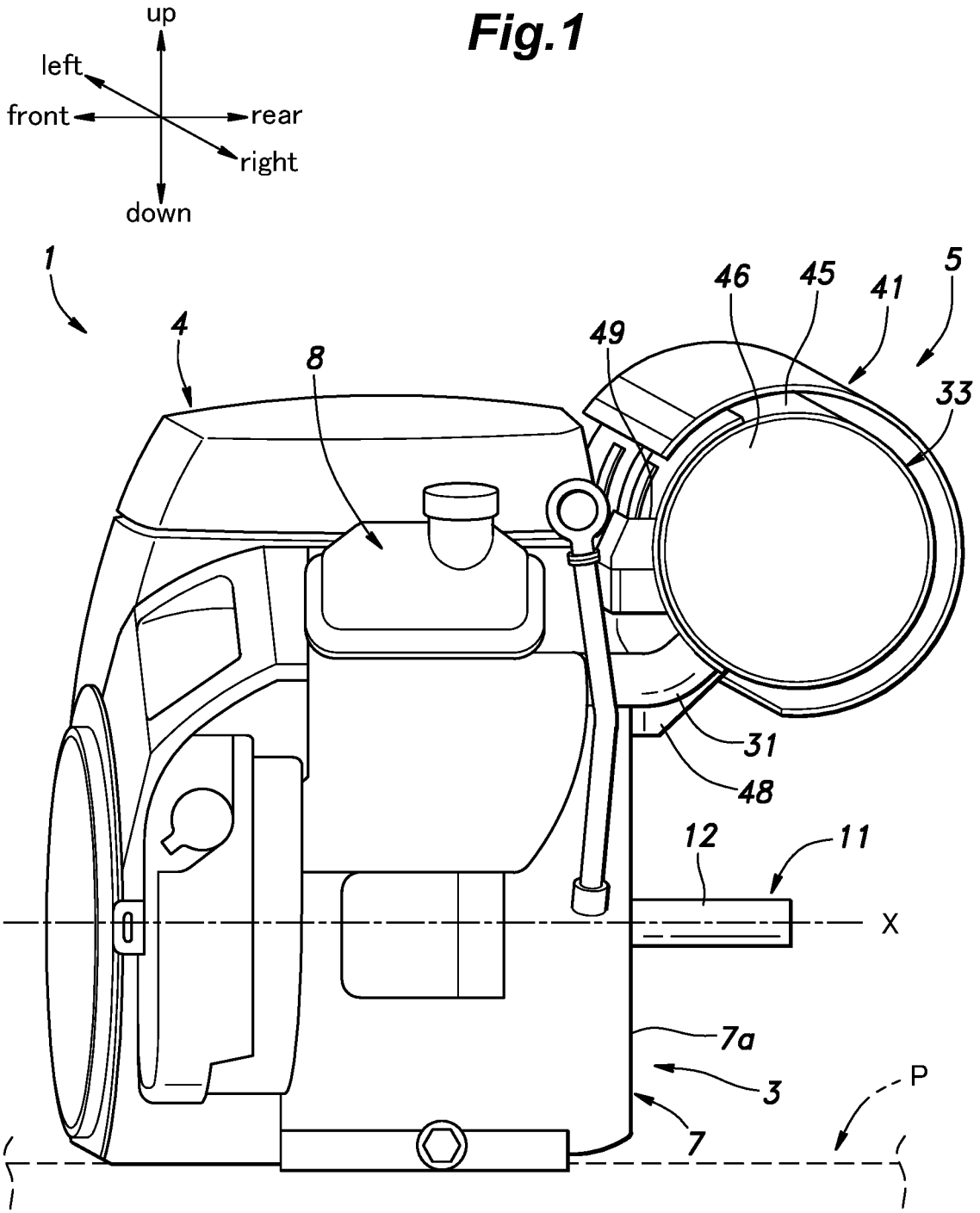
FIG. 1 is a perspective view showing a V-type engine according to an embodiment of the present invention.

In the following, a V-type engine 1 (hereinafter abbreviated as "engine 1") as an internal combustion engine according to an embodiment of the present invention will be described with reference to FIGS. 1 to 5. Hereinafter, for convenience of explanation, a left side in FIG. 1 is defined as a front side of the engine 1. Further, in this specification, when an expression like "fixed by bolt(s) (not shown)" is used, a member may be fixed by normal bolt(s) having a screw on only one side or by stud bolt(s) having screws on both sides.

With reference to FIG. 1, the engine 1 consists of a general-purpose engine used as a power source of a work machine P. For example, the work machine P consists of a cutting machine such as a concrete cutter, a floor treatment machine such as a floor leveler, a high-pressure washer, a generator, or the like. The engine 1 consists of an OHV air-cooled engine including two cylinders. In another embodiment, the engine 1 may consist of an engine (for example, an OHC engine) other than an OHV engine, an engine (for example, a water-cooled engine) other than an air-cooled engine, or an engine including three or more cylinders. Further, in another embodiment, the engine 1 may consist of a multicylinder engine (for example, an in-line engine) other than a V-type engine.

The engine 1 includes an engine body 3, an air cleaner 4 arranged above the engine body 3, an exhaust device 5 arranged on an upper rear side of the engine body 3. In the following, these components of the engine 1 will be described in order.

<Engine Body 3>

Figure 2:
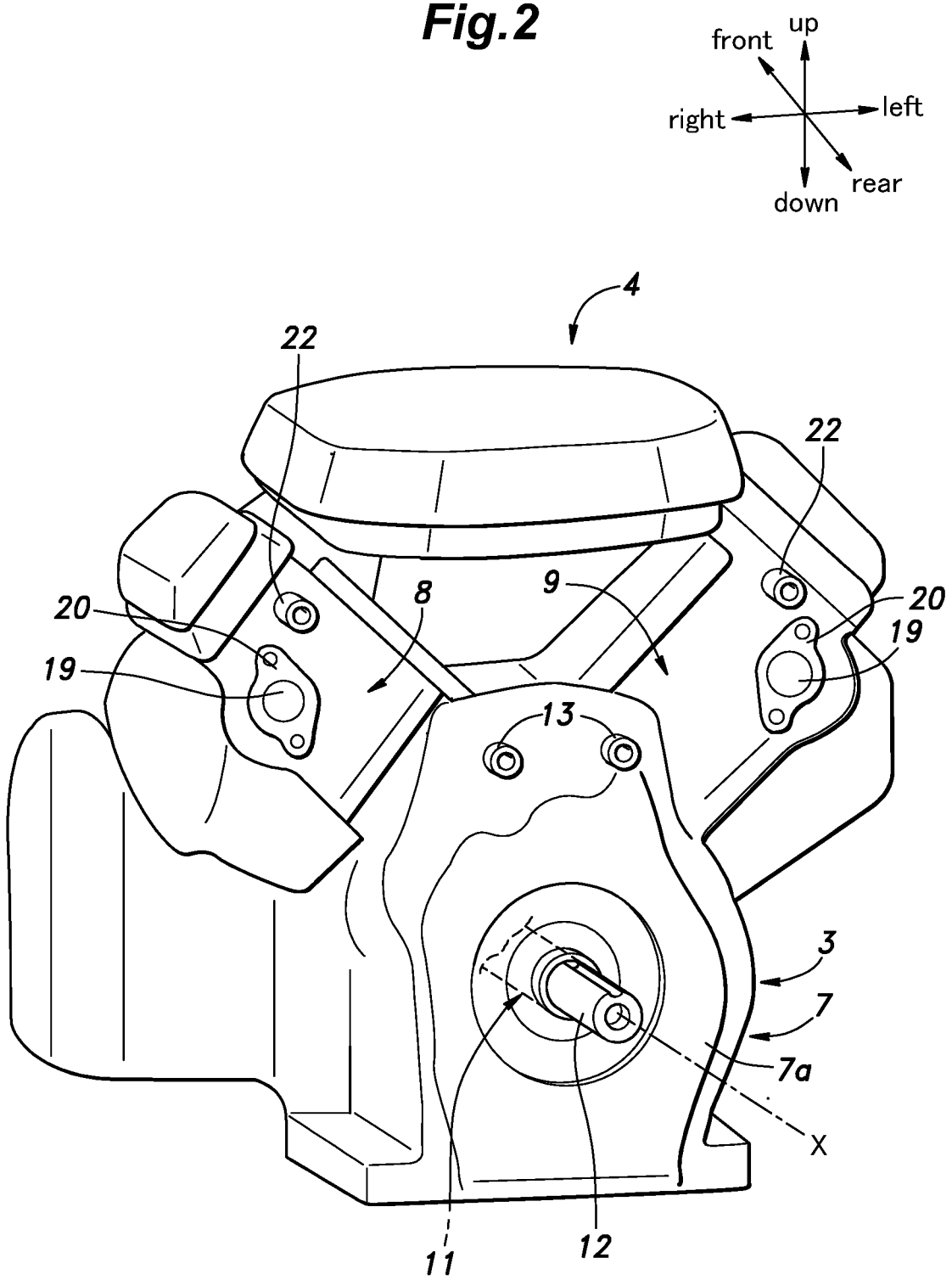
FIG. 2 is a perspective view showing an engine body and an air cleaner according to the embodiment of the present invention.

With reference to FIG. 2, the engine body 3 includes a crankcase 7, a first cylinder bank 8 extending to an upper right side from the crankcase 7, and a second cylinder bank 9 extending to an upper left side from the crankcase 7.

A crankshaft 11 is rotatably supported by a central portion of the crankcase 7. The crankshaft 11 is configured to rotate around a rotation axis X extending in the front-and-rear direction. That is, the engine 1 consists of a horizontal engine in which the rotation axis X of the crankshaft 11 extends in the horizontal direction. In another embodiment, the engine 1 may be a vertical engine in which the rotation axis X of the crankshaft 11 extends in the up-and-down direction. In such a case, for example, the work machine P is a riding-type lawn mower. A power take-off shaft 12 (PTO shaft: an example of an output portion) is provided at a rear end of the crankshaft 11. The PTO shaft 12 is connected to a work unit of the work machine P (for example, a blade of the concrete cutter), and the work unit of the work machine P is configured to rotate according to the rotation of the PTO shaft 12. The PTO shaft 12 protrudes rearward from a rear surface 7*a* (one side surface) of the crankcase 7 and extends in the front-and-rear direction. A pair of left and right first fixed bosses 13 are provided on an upper portion of the rear surface 7*a* of the crankcase 7.

The first and second cylinder banks 8, 9 are aligned in the lateral direction (the width direction of the engine body 3). Each of the first and second cylinder banks 8, 9, is provided diagonally above the crankcase 7.

In a lower portion (cylinder) of each of the first and second cylinder banks 8, 9, a piston (not shown) is accommodated so as to reciprocate. The piston is connected to the crankshaft 11 via a connecting rod (not shown).

An upper portion (cylinder head) of each of the first and second cylinder banks 8, 9 defines a combustion chamber (not shown) together with the piston. On a laterally inner surface of the upper portion of each of the first and second cylinder banks 8, 9, an intake port (not shown) communicating with the combustion chamber opens. On a rear surface of the upper portion of each of the first and second cylinder banks 8, 9, an exhaust port 19 communicating with the combustion chamber opens and a flange surface 20 is formed around the exhaust port 19. On the rear surface of the upper portion of each of the first and second cylinder banks 8, 9, a second fixed boss 22 is provided above the flange surface 20.

<Air Cleaner 4>

With reference to FIGS. 1 and 2, the air cleaner 4 has a flat shape (flat plate-like shape) elongated in the lateral direction and the front-and-rear direction. In another embodiment, the air cleaner 4 may have a cylindrical shape (canister-like shape). The air cleaner 4 is arranged between the first and second cylinder banks 8, 9 of the engine body 3. The air cleaner 4 is connected to the intake port (not shown) of each of the first and second cylinder banks 8, 9 via an intake pipe (not shown), and thus the air cleaned by the air cleaner 4 is introduced into the combustion chamber (not shown) via the intake port.

<Exhaust Device 5>

The exhaust device 5 is a device configured to discharge the exhaust gas discharged from the engine body 3 to an outside of the engine 1. Hereinafter, an expression "upstream" and an expression "downstream" indicate "upstream" and "downstream" in an exhaust direction (namely, a direction in which the exhaust gas flows inside the exhaust device 5) respectively. One-dot chain line arrows appropriately attached to each figure indicate the exhaust direction.

Figure 3:
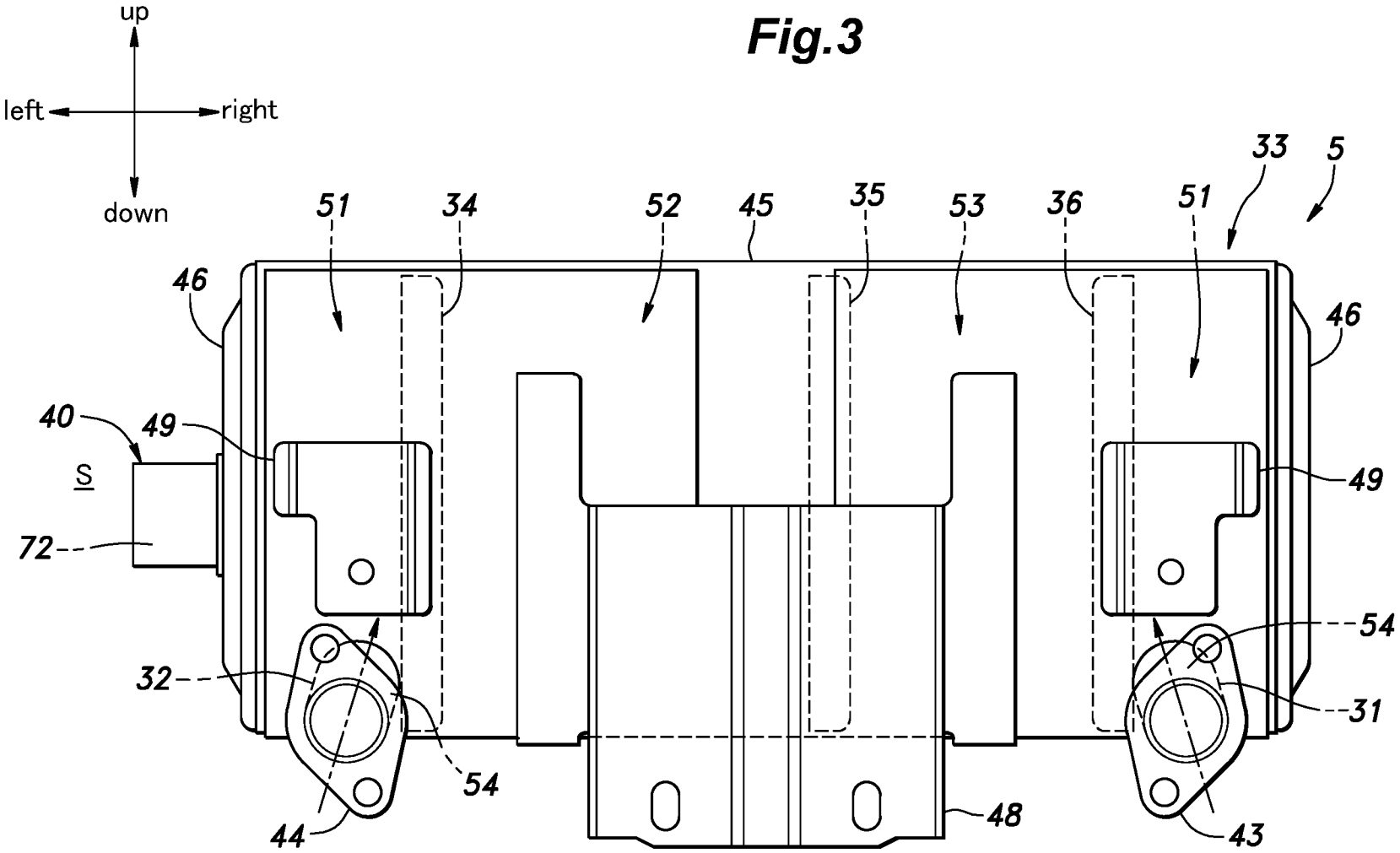
FIG. 3 is a front view showing an exhaust device according to the embodiment of the present invention.
Figure 4:
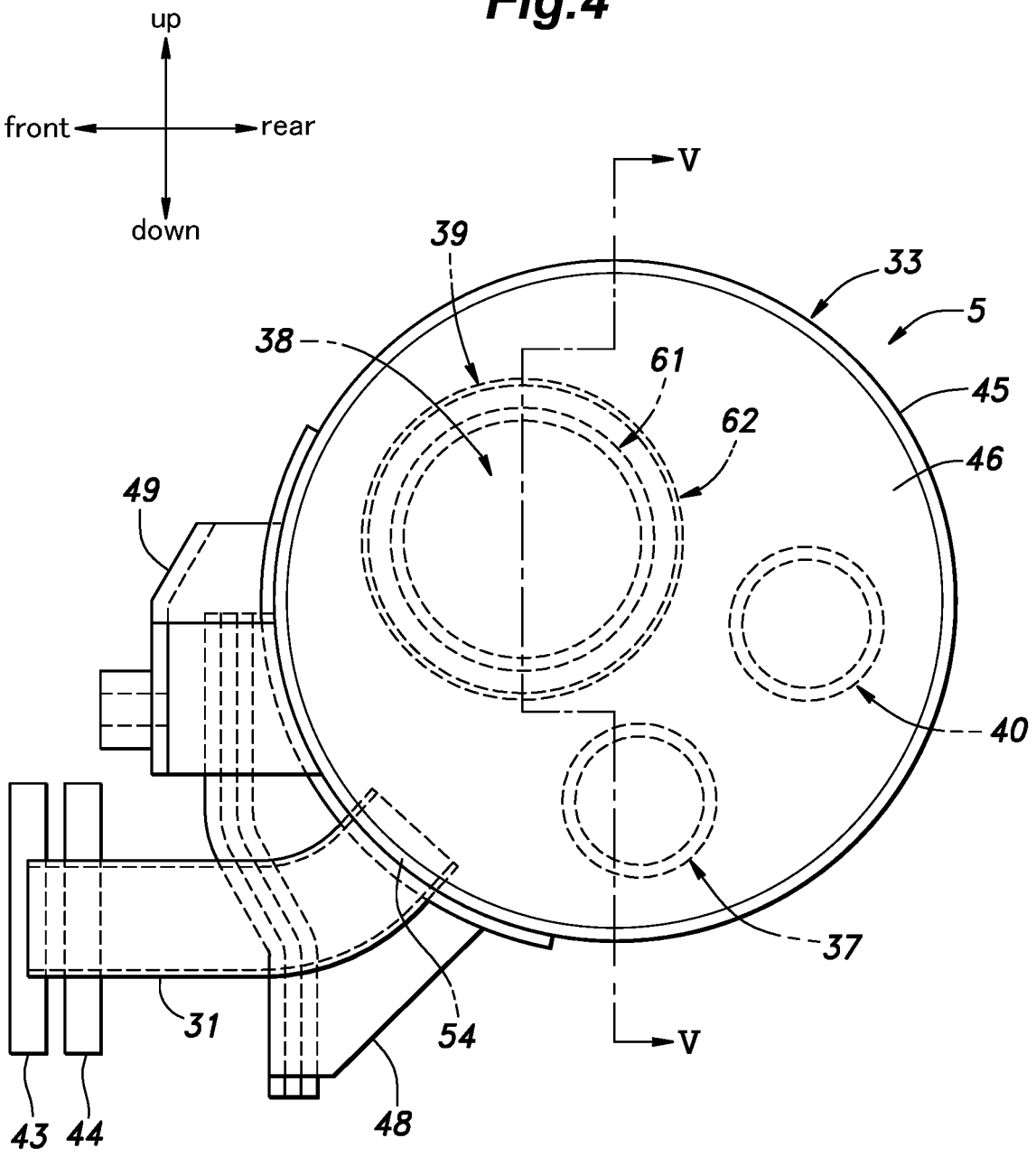
FIG. 4 is a side view showing the exhaust device according to the embodiment of the present invention.
Figure 5:
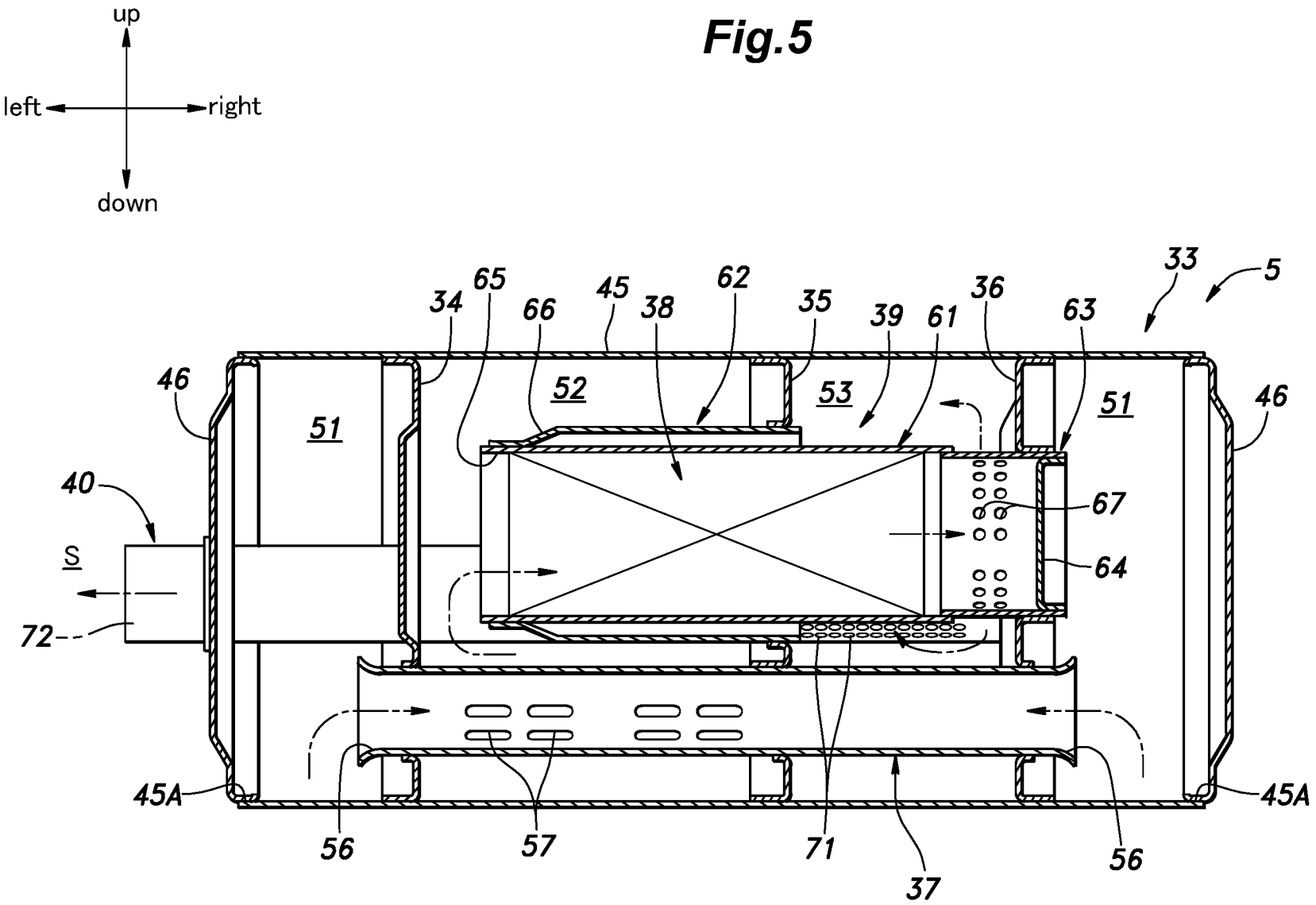
FIG. 5 is a cross-sectional view taken along a line V-V of FIG. 4.

With reference to FIGS. 3 to 5, the exhaust device 5 includes first and second exhaust pipes 31, 32, a muffler 33, a plurality of partition walls 34 to 36, a communication pipe 37, a catalyst 38, a catalyst case 39, an outlet pipe 40, and a cover 41 (see FIG. 1). In the following, these components of the exhaust device 5 will be described in order.

<First and Second Exhaust Pipes 31, 32>

With reference to FIGS. 3 and 4, the first and second exhaust pipes 31, 32 of the exhaust device 5 are aligned in the lateral direction. A front portion (upstream portion) of each of the first and second exhaust pipes 31, 32 extends linearly from a front side to a rear side. A rear portion (downstream portion) of each of the first and second exhaust pipes 31, 32 curves and extends from a lower side to an upper side.

On an outer circumference of a front end (upstream end) of the first exhaust pipe 31, a first fixed flange 43 is provided. The first fixed flange 43 is fixed to the flange surface 20 (see FIG. 2) of the first cylinder bank 8 by a pair of bolts (not shown). Accordingly, the front end of the first exhaust pipe 31 is connected to the exhaust port 19 (see FIG. 2) of the first cylinder bank 8.

With reference to FIG. 3, on an outer circumference of a front end (upstream end) of the second exhaust pipe 32, a second fixed flange 44 is provided. The second fixed flange 44 is fixed to the flange surface 20 (see FIG. 2) of the second cylinder bank 9 by a pair of bolts (not shown). Accordingly, the front end of the second exhaust pipe 32 is connected to the exhaust port 19 (see FIG. 2) of the second cylinder bank 9.

<Muffler 33>

With reference to FIG. 1, the muffler 33 of the exhaust device 5 is arranged on a rear side of the air cleaner 4. The muffler 33 is arranged above the PTO shaft 12 and protrudes more rearward than the rear surface 7*a* (one side surface) of the crankcase 7. The muffler 33 is arranged along the rear surfaces of the first and second cylinder banks 8, 9. The muffler 33 extends in the lateral direction from an upper end side (distal end side) of the first cylinder bank 8 to an upper end side (distal end side) of the second cylinder bank 9.

With reference to FIGS. 3 to 5, the muffler 33 has a cylindrical shape (an example of a tubular shape) elongated in the lateral direction. That is, in the present embodiment, the longitudinal direction of the muffler 33 matches the lateral direction. In another embodiment, the muffler 33 may have a shape (for example, a polygonal tubular shape) other than a cylindrical shape.

The muffler 33 includes a tubular portion 45 extending in the lateral direction, and a pair of lid portions 46 (left and right lid portions 46) covering openings 45A at both lateral ends of the tubular portion 45. In a laterally central portion on an outer circumferential surface of the tubular portion 45, a fixed bracket 48 protrudes forward. The fixed bracket 48 is fixed to the pair of left and right first fixed bosses 13 (see FIG. 2) of the crankcase 7 by a pair of bolts (not shown). On left and right portions of the outer circumferential surface of the tubular portion 45, a pair of left and right fixed stays 49 protrudes forward. Each fixed stay 49 is fixed to the second fixed boss 22 (see FIG. 2) of each of the first and second cylinder banks 8, 9 by a bolt (not shown).

With reference to FIG. 5, a plurality of muffling chambers 51 to 53 is formed inside the muffler 33. The muffling chambers 51 to 53 include a pair of first muffling chambers 51 (left and right first muffling chambers 51) formed at both lateral ends (both ends in the longitudinal direction) of the muffler 33, and second and third muffling chambers 52, 53 formed between the pair of first muffling chambers 51. Volumes of the muffling chambers 51 to 53 become smaller in order of "a total volume of the pair of first muffling chambers 51, a volume of the second muffling chamber 52, and a volume of the third muffling chamber 53". That is, a formula "the total volume of the pair of first muffling chambers 51>the volume of the second muffling chamber 52>the volume of the third muffling chamber 53" is satisfied.

With reference to FIG. 3, in a lower front portion of each of the pair of first muffling chambers 51, an inlet port 54 for the exhaust gas is provided. The inlet port 54 consists of a hole provided in the tubular portion 45 of the muffler 33. A rear end (downstream end) of the first exhaust pipe 31 is connected to the inlet port 54 of the right first muffling chamber 51, and a rear end (downstream end) of the second exhaust pipe 32 is connected to the inlet port 54 of the left first muffling chamber 51.

<Partition Walls 34 to 36>

With reference to FIG. 5, the partition walls 34 to 36 of the exhaust device 5 are accommodated in the muffler 33.

The partition walls 34 to 36 are arranged at intervals in the lateral direction. The partition walls 34 to 36 include a first partition wall 34 laterally separating the left first muffling chamber 51 and the second muffling chamber 52, a second partition wall 35 laterally separating the second muffling chamber 52 and the third muffling chamber 53, and a third partition wall 36 laterally separating the third muffling chamber 53 and the right first muffling chamber 51.

<Communication Pipe 37>

With reference to FIG. 5, the communication pipe 37 of the exhaust device 5 is accommodated in the muffler 33. The communication pipe 37 extends in the lateral direction and penetrates the first to third partition walls 34 to 36. At both lateral ends of the communication pipe 37, communication ports 56 communicating with the pair of first muffling chambers 51 are provided. On an outer circumferential portion of the communication pipe 37, multiple communication holes 57 communicating with the second muffling chamber 52 are provided. According to the above configuration, the pair of first muffling chambers 51 and the second muffling chamber 52 communicate with each other via the communication pipe 37.

<Catalyst 38>

With reference to FIG. 5, the catalyst 38 of the exhaust device 5 has a columnar shape elongated in the lateral direction. That is, in the present embodiment, the longitudinal direction of the catalyst 38 matches the lateral direction. For example, the catalyst 38 consists of a ternary catalyst. The catalyst 38 is configured to purify the exhaust gas by changing a harmful substance in the exhaust gas, which is discharged from the engine body 3 via the first and second exhaust pipes 31, 32, into a harmless substance by a chemical reaction.

The catalyst 38 is accommodated in the muffler 33. The catalyst 38 extends in the lateral direction and penetrates the second partition wall 35. Accordingly, the second muffling chamber 52 and the third muffling chamber 53 communicate with each other via the catalyst 38.

<Catalyst Case 39>

With reference to FIG. 5, the catalyst case 39 of the exhaust device 5 has a cylindrical shape (an example of a tubular shape) elongated in the lateral direction. That is, in the present embodiment, the longitudinal direction of the catalyst case 39 matches the lateral direction. In another embodiment, the catalyst case 39 may have a shape (for example, a polygonal tubular shape) other than a cylindrical shape. The catalyst case 39 is accommodated in the muffler 33, and accommodates the catalyst 38. The catalyst case 39 extends in the lateral direction and penetrates the second and third partition walls 35, 36.

The catalyst case 39 includes a first tubular body 61, a second tubular body 62, a third tubular body 63, and a lid body 64.

The first tubular body 61 extends in the lateral direction and penetrates the second partition wall 35. The first tubular body 61 covers an outer circumference of the catalyst 38. An inner circumferential surface of the first tubular body 61 is fixed to an outer circumferential surface of the catalyst 38 by welding. At a left end (upstream end: first end) of the first tubular body 61, an inflow port 65 communicating with the second muffling chamber 52 is provided. A right end (downstream end: second end) of the first tubular body 61 is arranged inside the third muffling chamber 53.

The second tubular body 62 extends in the lateral direction and penetrates the second partition wall 35. An outer circumference of a right end (downstream end) of the second tubular body 62 is fixed to the second partition wall 35 by welding. Accordingly, the second tubular body 62 is supported by the second partition wall 35. The second tubular body 62 is arranged on an outer circumference of the first tubular body 61. In a left side portion of the second tubular body 62, a diameter reduced portion 66 is provided. The diameter of the diameter reduced portion 66 is reduced from a right side (downstream side) to a left side (upstream side). On a left side (upstream side) of the diameter reduced portion 66, an inner circumference of a left end (upstream end) of the second tubular body 62 is fixed to an outer circumference of the left end of the first tubular body 61 by welding.

The third tubular body 63 extends in the lateral direction and penetrates the third partition wall 36. A right end (second end) of the third tubular body 63 is fitted into the third partition wall 36 so as to slide relative to the third partition wall 36. Accordingly, the third tubular body 63 is supported by the third partition wall 36. An outer circumference of a left end (first end) of the third tubular body 63 is fixed to an inner circumference of the right end of the first tubular body 61 by welding. On an outer circumferential portion of the third tubular body 63, multiple outer circumferential holes 67 communicating with the third muffling chamber 53 are provided.

On a right side (downstream side) of the multiple outer circumferential holes 67, the lid body 64 is fixed to an inner circumference of the right end of the third tubular body 63 by welding. Accordingly, the lid body 64 covers the right end of the third tubular body 63.

<Outlet Pipe 40>

With reference to FIG. 5, the outlet pipe 40 of the exhaust device 5 extends in the lateral direction and penetrates the left lid portion 46 of the muffler 33 and the first and second partition walls 34, 35. In an outer circumferential portion of the outlet pipe 40, multiple passage holes 71 communicating with the third muffling chamber 53 are provided. A left end of the outlet pipe 40 protrudes to a left side (one lateral side) of the muffler 33. At the left end of the outlet pipe 40, an outlet port 72 communicating with an external space S on the left side (one lateral side) of the muffler 33 is provided. According to the above configuration, the third muffling chamber 53 and the external space S on the left side of the muffler 33 communicate with each other via the outlet pipe 40.

Figure 6:
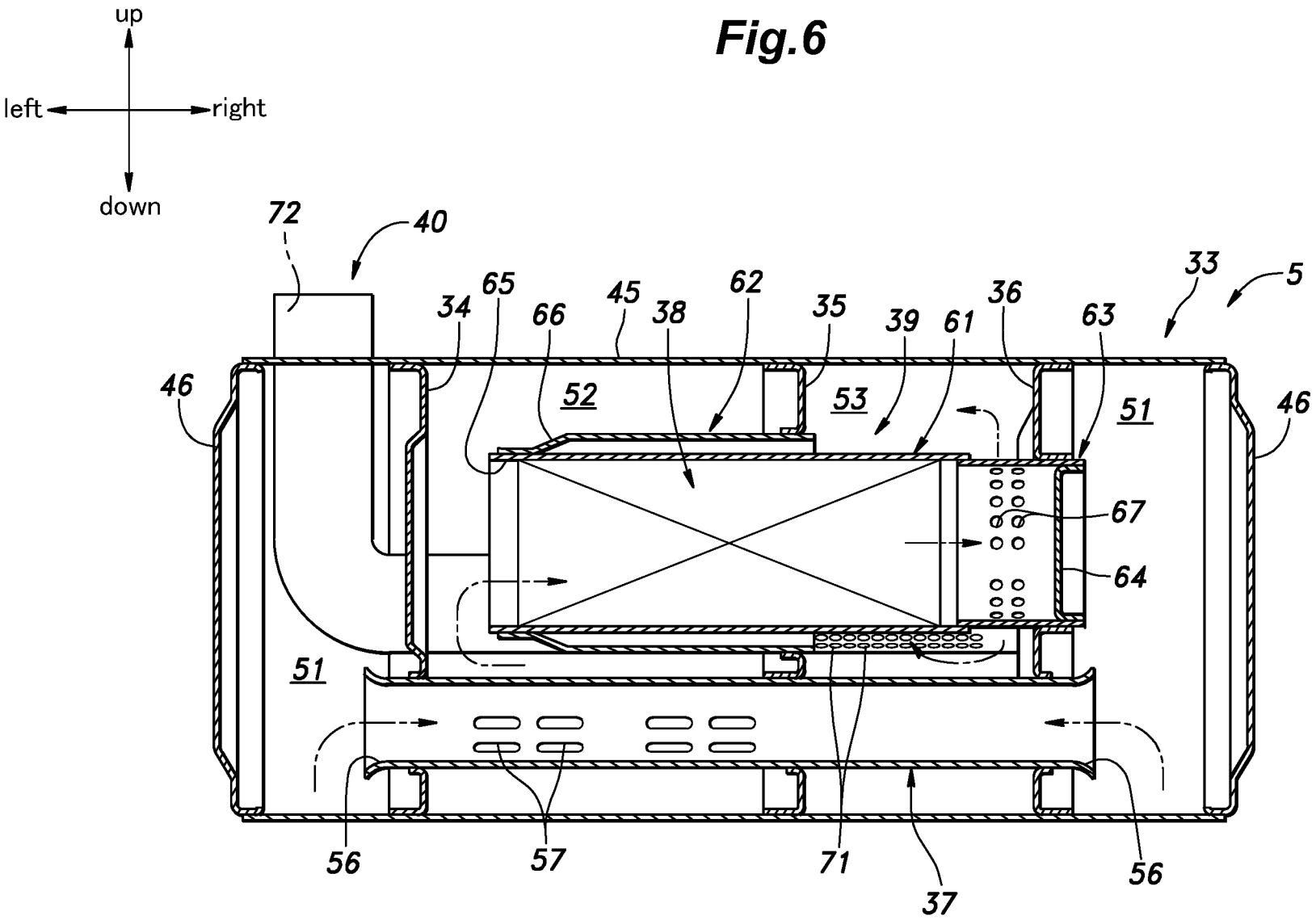
FIG. 6 is a cross-sectional view showing an exhaust device according to another embodiment of the present invention.

In another embodiment, the outlet pipe 40 may protrude to a right side of the muffler 33. Further, in another embodiment, as shown in FIG. 6, the outlet pipe 40 may be bent and penetrate the tubular portion 45 of the muffler 33, thereby protruding from an outer circumferential surface of the tubular portion 45. In this way, the configuration and arrangement of the outlet pipe 40 can be selected according to the configuration and the like of the work machine P.

<Cover 41>

With reference to FIG. 1, the cover 41 of the exhaust device 5 covers an outer surface (a surface facing away from a surface opposed to the engine body 3) of the muffler 33. The cover 41 is fixed to the muffler 33 by a plurality of bolts (not shown). The cover 41 is provided with multiple punch holes (not shown) over the entire area thereof.

<Flow of the Exhaust Gas>

With reference to FIG. 5, when the engine 1 is driven, the exhaust gas is discharged from the exhaust ports 19 of the first and second cylinder banks 8, 9. The exhaust gas discharged from the exhaust ports 19 passes through the first and second exhaust pipes 31, 32, and then flows into the pair of first muffling chambers 51 of the muffler 33 via the inlet ports 54. The exhaust gas that has flowed into the pair of first muffling chambers 51 passes through the pair of first muffling chambers 51, and then flows into the communication pipe 37 via the communication ports 56. The exhaust gas that has flowed into the communication pipe 37 flows into the second muffling chamber 52 of the muffler 33 via the multiple communication holes 57. The exhaust gas that has flowed into the second muffling chamber 52 passes through the second muffling chamber 52, and then flows into the first tubular body 61 of the catalyst case 39 via the inflow port 65. The exhaust gas that has flowed into the first tubular body 61 of the catalyst case 39 passes through the first tubular body 61 and the third tubular body 63 of the catalyst case 39 in order, and then flows into the third muffling chamber 53 of the muffler 33 via the multiple outer circumferential holes 67. In this way, the exhaust gas passes through the catalyst case 39, and thus the exhaust gas is purified by the catalyst 38 accommodated in the catalyst case 39.

The exhaust gas that has flowed into the third muffling chamber 53 of the muffler 33 passes through the third muffling chamber 53, and then flows into the outlet pipe 40 through the multiple passage holes 71. The exhaust gas that has flowed into the outlet pipe 40 passes through the outlet pipe 40, and then is discharged to the external space S on the left side of the muffler 33 via the outlet port 72. The exhaust gas passes through the muffler 33 in this way, and thus the exhaust sound is reduced.

<Effects>

In the present embodiment, the muffling chambers 51 to 53 include: the pair of first muffling chambers 51 each provided with the inlet port 54 for the exhaust gas, the second muffling chamber 52 communicating with the pair of first muffling chambers 51 via the communication pipe 37, and the third muffling chamber 53 communicating with the second muffling chamber 52 via the catalyst 38. According to such a configuration, the exhaust gas introduced from either of the inlet ports 54 of the pair of first muffling chambers 51 passes through the pair of first muffling chambers 51, the communication pipe 37, the second muffling chamber 52, the catalyst 38, and the third muffling chamber 53 in this order. That is, the exhaust gas introduced from the inlet ports 54 of the pair of first muffling chambers 51 passes through similar flowing paths. Accordingly, it is possible to reduce the exhaust sound of the exhaust gas introduced from the inlet ports 54 of the pair of first muffling chambers 51 in a well-balanced manner.

Further, the partition walls 34 to 36 include the first partition wall 34 separating the left first muffling chamber 51 and the second muffling chamber 52, the second partition wall 35 separating the second muffling chamber 52 and the third muffling chamber 53, and the third partition wall 36 separating the third muffling chamber 53 and the right first muffling chamber 51. According to such a configuration, the pair of first muffling chambers 51, the second muffling chamber 52, and the third muffling chamber 53 can be formed inside the muffler 33 with a simple configuration.

Further, the third muffling chamber 53 communicates with the external space S on the left side (one side in the longitudinal direction) of the muffler 33 via the outlet pipe 40 extending in the longitudinal direction of the muffler 33. According to such a configuration, the third muffling chamber 53 can communicate with the external space S on the left side of the muffler 33 with a simple configuration.

Further, the outlet pipe 40 penetrates the left lid portion 46 of the muffler 33 and the first and second partition walls 34, 35, and protrudes to the left side (one side in the longitudinal direction) of the muffler 33. According to such a configuration, the outlet pipe 40 can be prevented from protruding from the outer circumferential surface of the tubular portion 45 of the muffler 33, so that the exhaust device 5 can be made compact.

Further, the communication pipe 37 extends in the longitudinal direction of the muffler 33, and penetrates the first to third partition walls 34 to 36. According to such a configuration, the pair of first muffling chambers 51 separated by the second and third muffling chambers 52 and 53 can communicate with each other with a simple configuration.

Further, the communication ports 56 communicating with the pair of first muffling chambers 51 are provided at both lateral ends of the communication pipe 37, and the multiple communication holes 57 communicating with the second muffling chamber 52 are provided on the outer circumferential portion of the communication pipe 37. According to such a configuration, the exhaust gas that has flowed into the communication pipe 37 via the communication ports 56 diffuses into the second muffling chamber 52 via the multiple communication holes 57. Accordingly, the muffling performance of the muffler 33 can be improved.

Further, the catalyst 38 and the catalyst case 39 penetrate the second partition wall 35. According to such a configuration, the second muffling chamber 52 and the third muffling chamber 53 can communicate with each other via the catalyst 38 with a simple configuration.

Further, the second tubular body 62 of the catalyst case 39 is supported by the second partition wall 35, and the third tubular body 63 of the catalyst case 39 is supported by the third partition wall 36. According to such a configuration, the second and third partition walls 35, 36 can support the catalyst case 39 in a well-balanced manner.

Further, the left end (first end) of the third tubular body 63 is fixed to the inner circumference of the right end (second end) of the first tubular body 61, the right end (second end) of the third tubular body 63 is covered with the lid body 64, and the multiple outer circumferential holes 67 communicating with the third muffling chamber 53 are provided on the outer circumferential portion of the third tubular body 63. According to such a configuration, the exhaust gas flowing from the first tubular body 61 to the third tubular body 63 diffuses into the third muffling chamber 53 via the multiple outer circumferential holes 67. Accordingly, the muffling performance of the muffler 33 can be improved.

Further, the third tubular body 63 is welded to the first tubular body 61 and fitted into the third partition wall 36 so as to slide relative to the third partition wall 36. According to such a configuration, even if the catalyst 38 thermally expands and extends in the longitudinal direction of the muffler 33, the third tubular body 63 slides relative to the third partition wall 36, so that the extension of the catalyst 38 can be absorbed. Accordingly, the damage to the catalyst 38 and the catalyst case 39 can be suppressed.

Further, the volumes of the muffling chambers 51 to 53 become smaller in order of "the total volume of the pair of first muffling chambers 51, the volume of the second muffling chamber 52, and the volume of the third muffling chamber 53". According to such a configuration, the volumes of the muffling chambers 51 to 53 can be gradually decreased from an upstream side to a downstream side. Accordingly, the muffling performance of the muffler 33 can be improved.

Further, the PTO shaft 12 protrudes on the rear surface of the engine body 3 (more specifically, the rear surface 7*a* of the crankcase 7), and the muffler 33 is arranged along the rear surface of the engine body 3 (more specifically, the rear surfaces of the first and second cylinder banks 8, 9). According to such a configuration, the muffler 33 can be arranged along the rear surface (that is, the surface on which the PTO shaft 12 protrudes) of the engine body 3. Accordingly, the muffler 33 is less likely to limit the layout of other parts.

Concrete embodiments of the present invention have been described in the foregoing, but the present invention should not be limited by the foregoing embodiments and various modifications and alterations are possible within the scope of the present invention.

The invention claimed is:

1. An exhaust device of an engine, comprising:

a muffler provided with a plurality of muffling chambers separated by a plurality of partition walls, a communication pipe accommodated in the muffler and penetrating at least one of the partition walls, and a catalyst accommodated in the muffler and penetrating at least one of the partition walls, wherein the muffling chambers include:

a pair of first muffling chambers each provided with an inlet port for exhaust gas;

a second muffling chamber communicating with the pair of first muffling chambers via the communication pipe; and a third muffling chamber communicating with the second muffling chamber via the catalyst, wherein the pair of first muffling chambers are formed at both ends of the muffler in a longitudinal direction thereof, the second muffling chamber and the third muffling chamber are formed between the pair of first muffling chambers, and the partition walls include:

a first partition wall separating one of the pair of first muffling chambers and the second muffling chamber;

a second partition wall separating the second muffling chamber and the third muffling chamber; and a third partition wall separating the third muffling chamber and another of the pair of first muffling chambers.

2. The exhaust device according to claim 1, wherein the third muffling chamber communicates with an external space on one side of the muffler in the longitudinal direction thereof via an outlet pipe extending in the longitudinal direction of the muffler.

3. The exhaust device according to claim 2, wherein the muffler includes:

a tubular portion extending in the longitudinal direction of the muffler; and a pair of lid portions covering openings at both ends of the tubular portion, and the outlet pipe penetrates one of the pair of lid portions, the first partition wall, and the second partition wall, and protrudes to the one side of the muffler in the longitudinal direction thereof.

4. The exhaust device according to claim 1, wherein the communication pipe extends in the longitudinal direction of the muffler, and penetrates the first partition wall, the second partition wall, and the third partition wall.

5. The exhaust device according to claim 4, wherein communication ports communicating with the pair of first muffling chambers are provided at both ends of the communication pipe, and multiple communication holes communicating with the second muffling chamber are provided on an outer circumferential portion of the communication pipe.

6. The exhaust device according to claim 1, wherein the catalyst is accommodated in a catalyst case, and the catalyst and the catalyst case penetrate the second partition wall.

7. The exhaust device according to claim 6, wherein the catalyst case includes:

a first tubular body extending in the longitudinal direction of the muffler and covering an outer circumference of the catalyst;

a second tubular body fixed to an outer circumference of a first end of the first tubular body; and a third tubular body fixed to an inner circumference of a second end of the first tubular body, the second tubular body is supported by the second partition wall, and the third tubular body is supported by the third partition wall.

8. The exhaust device according to claim 7, wherein a first end of the third tubular body is fixed to the inner circumference of the second end of the first tubular body, a second end of the third tubular body is covered with a lid body, and multiple outer circumferential holes communicating with the third muffling chamber are provided on an outer circumferential portion of the third tubular body.

9. The exhaust device according to claim 7, wherein the first tubular body is welded to the catalyst, the second tubular body is welded to the first tubular body and the second partition wall, and the third tubular body is welded to the first tubular body and fitted into the third partition wall so as to slide relative to the third partition wall.

10. The exhaust device according to claim 1, wherein volumes of the muffling chambers become smaller in order of a total volume of the pair of first muffling chambers, a volume of the second muffling chamber, and a volume of the third muffling chamber.

11. The exhaust device according to claim 1, wherein the engine includes an engine body rotatably supporting a crankshaft, an output portion of the crankshaft protrudes on one side surface of the engine body, and the muffler is arranged along the one side surface of the engine body.

12. A work machine, comprising the engine including the exhaust device according to claim 1.

* * * * *